US007845119B2

(12) United States Patent
Black et al.

(10) Patent No.: US 7,845,119 B2
(45) Date of Patent: Dec. 7, 2010

(54) ACCESS UNIT WITH VARIABLE SIZE OPENING FOR CONSTRUCTION APPLICATION

(76) Inventors: Robert David Black, Oxford Safety Components, Oakview, Somerton Road, Upper Heyford, Bicester OX25 5LB (GB); John Alexander Black, Oxford Safety Components, Oakview, Somerton Road, Upper Heyford, Bicester, OX25 5LB (GB)

( * ) Notice: Subject to any disclaimer, the term of this patent is extended or adjusted under 35 U.S.C. 154(b) by 1029 days.

(21) Appl. No.: 10/529,573

(22) PCT Filed: Oct. 17, 2003

(86) PCT No.: PCT/GB03/04496

§ 371 (c)(1),
(2), (4) Date: Mar. 29, 2005

(87) PCT Pub. No.: WO2004/035961

PCT Pub. Date: Apr. 29, 2004

(65) Prior Publication Data

US 2006/0260217 A1 Nov. 23, 2006

(30) Foreign Application Priority Data

Oct. 18, 2002 (GB) ..... 0224292.3

(51) Int. Cl.

| | |
|---|---|
| ***E04G 21/04*** | (2006.01) |
| ***E04H 12/00*** | (2006.01) |
| ***E06C 1/00*** | (2006.01) |
| ***A62B 1/22*** | (2006.01) |

(52) U.S. Cl. ..... 52/127.2; 52/651.1; 52/638; 182/69.4; 182/138

(58) Field of Classification Search ..... 52/204, 52/204.56, 217, 248, 651.1, 638, 182, 127.2; 56/204; 304/2; 182/179, 184, 183, 201, 182/69.4, 138

See application file for complete search history.

(56) References Cited

U.S. PATENT DOCUMENTS 1,474,250 A 11/1923 Folliard (Continued)

FOREIGN PATENT DOCUMENTS

DE 195 46 536 C1 6/1997

(Continued)

*Primary Examiner*—Brian E Glessner
*Assistant Examiner*—Omar Hijaz
(74) *Attorney, Agent, or Firm*—Davis & Bujold, P.L.L.C.

(57) ABSTRACT

A constructional unit comprising: a support frame which is O-shaped in plan bounding an open central region, the support frame including first and second members which are each U-shaped in plan, each member being in the form of a base frame from which extend two side arms; the first and second members having their side arms telescopically engaged to define sides to the open central region of the O-shaped support frame; the telescopic engagement providing for—the spacing of the first base frame from the second base frame to be adjustable over a range of distance; and the temporary securing of the first member to the second member at a predetermined spacing; the base frame of the first member being adapted for location at a first level at a first working location; the second member being adapted, at a position remote from the first member, for location at a second level at a second working location by way of at least one leg pivotably attached at or near one end of the, or each, leg to the base frame of the second member or to a side arm thereof; the opposite end to the one end of the, or each, leg being adapted for location on the second working location; the second level being offset from and below the first level.

17 Claims, 3 Drawing Sheets

U.S. PATENT DOCUMENTS

| | | | | | |
|---|---|---|---|---|---|
| 2,485,165 | A | * | 10/1949 | Pollman | 182/223 |
| 3,128,842 | A | | 4/1964 | Satrum | |
| 4,371,057 | A | * | 2/1983 | Blier | 182/182.4 |

FOREIGN PATENT DOCUMENTS

| | | | |
|---|---|---|---|
| FR | 2 480 838 | | 10/1981 |
| FR | 2 663 075 | | 12/1991 |
| GB | 2 234 281 | A | 1/1991 |
| GB | 2 347 710 | A | 2/1999 |
| GB | 2 329 926 | A | 4/1999 |
| JP | 8-49426 | | 2/1996 |

* cited by examiner

ACCESS UNIT WITH VARIABLE SIZE OPENING FOR CONSTRUCTION APPLICATION

This application is a national stage completion of PCT/GB2003/004496 filed Oct. 17, 2003 which claims priority from British Application Serial No. 0224292.3 filed Oct. 18, 2002.

TECHNICAL FIELD

This invention relates to a constructional or access unit for construction application.

BACKGROUND ART

In erecting a building having more than one floor level there usually arises a need for a space to be left in a floor typically to install stairs between that and another floor. Such an opening needs to be protected in some way to prevent accidents arising from people or articles inadvertently dropping through the space. However the form of protection used should preferably not lead to access problems for acceptable use. A number of proposals have been made to enable such a space to be protected. However these do result in limitation, if not prevention, of the use of the space for passage of people or transfer of articles.

DISCLOSURE OF INVENTION

According to the present invention there is provided a constructional or access unit comprising:

a support frame which is O-shaped in plan bounding an open central region, the support frame including first and second members which are each U-shaped in plan, each member being in the form of a base frame from which extend two side arms; the first and second members having their side arms telescopically engaged to define sides to the open central region of the O-shaped support frame; the telescopic engagement providing for— the spacing of the first base frame from the and second base frame to be adjustable over a range of distances; and the temporary securing of the first member to the second member at a predetermined spacing;

the base frame of the first member being adapted for location at a first level at a first working location;

the second member being adapted, at a position remote from the first member, for location at a second level at a second working location by means of at least one leg pivotably attached at or near one end of the, or each, leg to the base frame of the second member or to a side arm thereof; the opposite end to the one end of the, or each, leg being adapted for location on the second working location; the second level being offset from and below the first level.

According to a first preferred version of the present invention the, or each, leg can be varied in length to provide for the support frame to be maintained horizontal or at a predetermined angle relative to horizontal.

According to a second preferred version of the present invention or of the first preferred version thereof a platform member is provided to which, in a first working position, serves to fill the open central region of the support frame so as to prevent the inadvertent passage of an article or person from above the support unit through the otherwise open central region and a second working position where the platform member is withdrawn to allow access through the open central region. Typically the platform member is, at least in part, of openwork construction to enable a view to be obtained through the open central region, when the platform member is in the first working position.

BRIEF DESCRIFION OF DRAWINGS

An exemplary embodiment of the present invention will now be described with reference to the accompanying drawings of a constructional unit of which:

MODE FOR CARRYING OUT THE INVENTION

Figure 1:
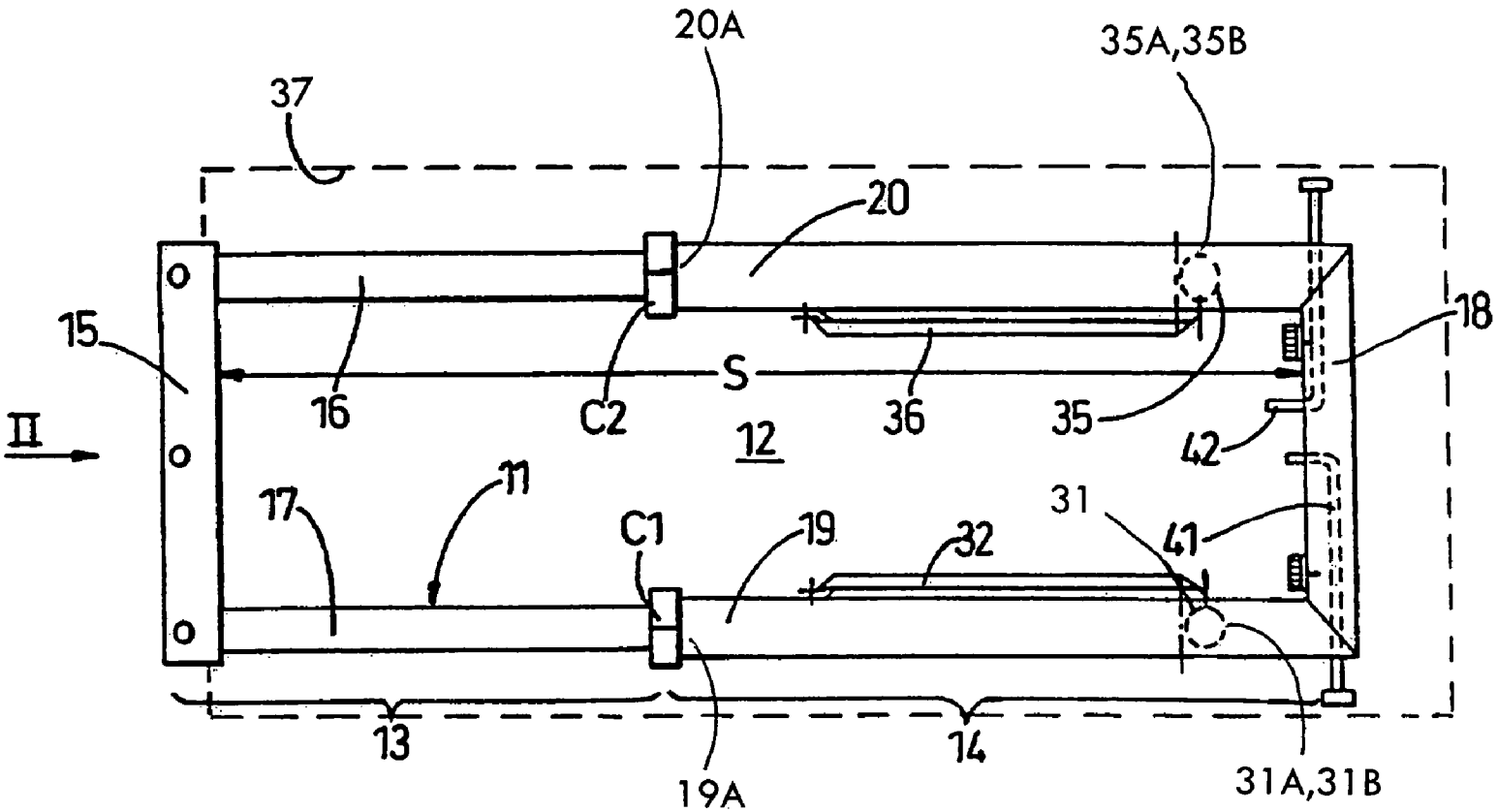
FIG. 1 is a plan view.

The figures variously show a constructional unit 11.

The unit 11 includes a support frame made up of first member 13 and a second member 14 which are each U-shaped in plan. First member 13 comprises a base frame 15 from which extend side arms 16, 17. Second member 14 is in the form of a base frame 18 from which extend side arms 19, 20.

Side arm 16 is telescoped with side arm 20 and side arm 17 is telescoped with side arm 19 to provide an O-shaped support frame around a clear central region 12. The telescopic engagement provides for the spacing S of the first base frame 15 from the second base frame 18 to be varied over a range of distances depending on the gap to be filled. Clamps C1, C2 on, respectively, ends 19A, 20A provide for the securing of the telescoped side arms of the first member 13 and the second member 14 at a predetermined value of spacing S.

The base frame 15 of the first member 13 includes a flange 15A by means of which the unit 11 is located in an opening 37 in floor F2 at a height L1, above a lower floor F1. The opening 37 forms the top of a stair well for stair 50.

Side arm 19 has pivotably attached to it end 30 of a telescopic prop 31 with upper tube 31A and lower adjustable foot 31B. Brace 32 enables the prop 31 to be fixed in the extended position shown in FIG. 2. When the unit 11 is not in use the prop 31 can be folded to lie beneath side arm 19.

Side arm 20 has pivotably attached to it end 34 of a telescopic prop 35 with upper tube 35A and lower adjustable foot 35B. Brace 36 enables the prop 35 to be fixed in the extended position comparable to that of shown to that of prop 31 in FIG. 2. When the unit 11 is not in use the prop 35 can be folded to lie beneath side arm 20.

Figure 2:
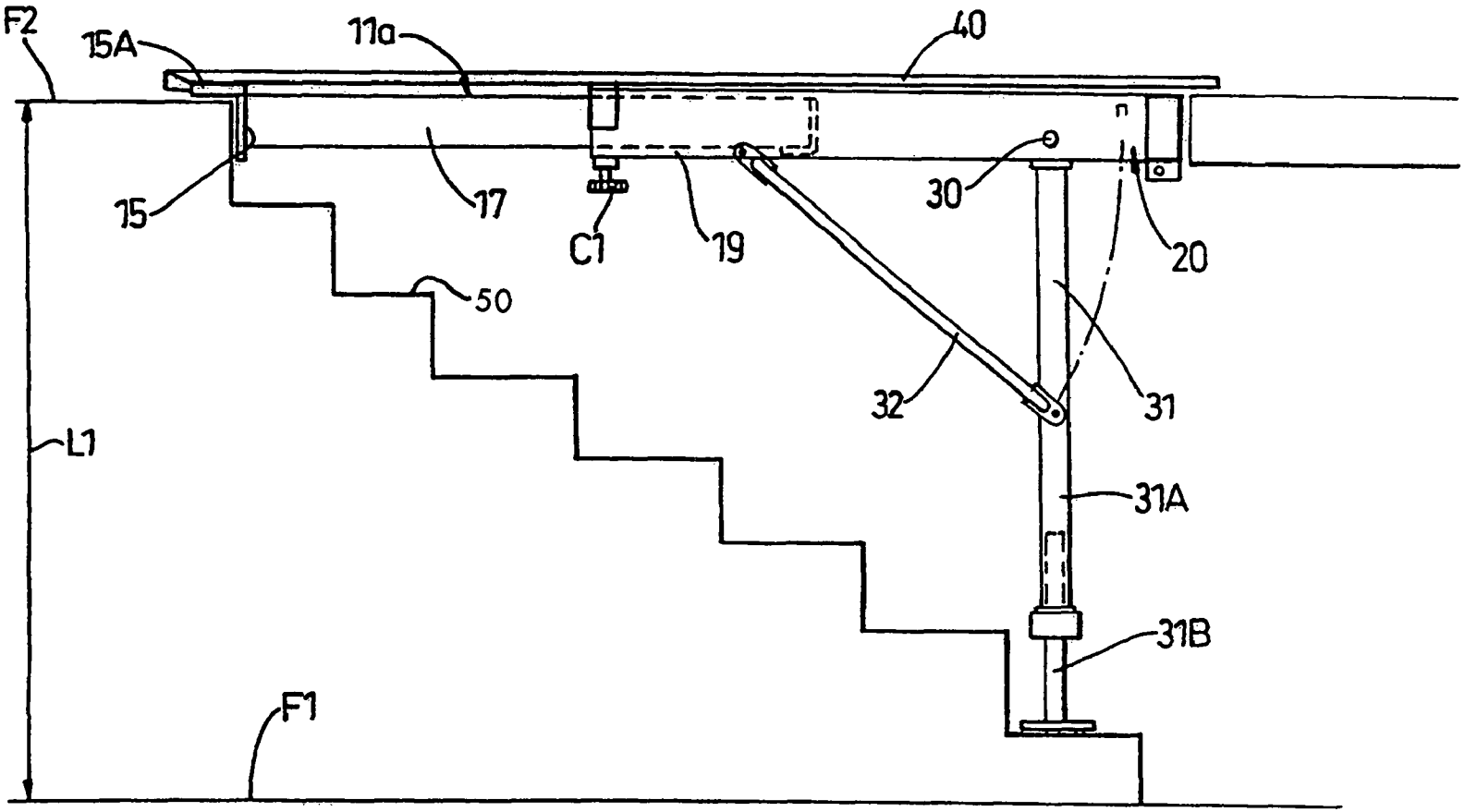
FIG. 2 is a side view in direction of arrow II of FIG. 1.
Figure 3:
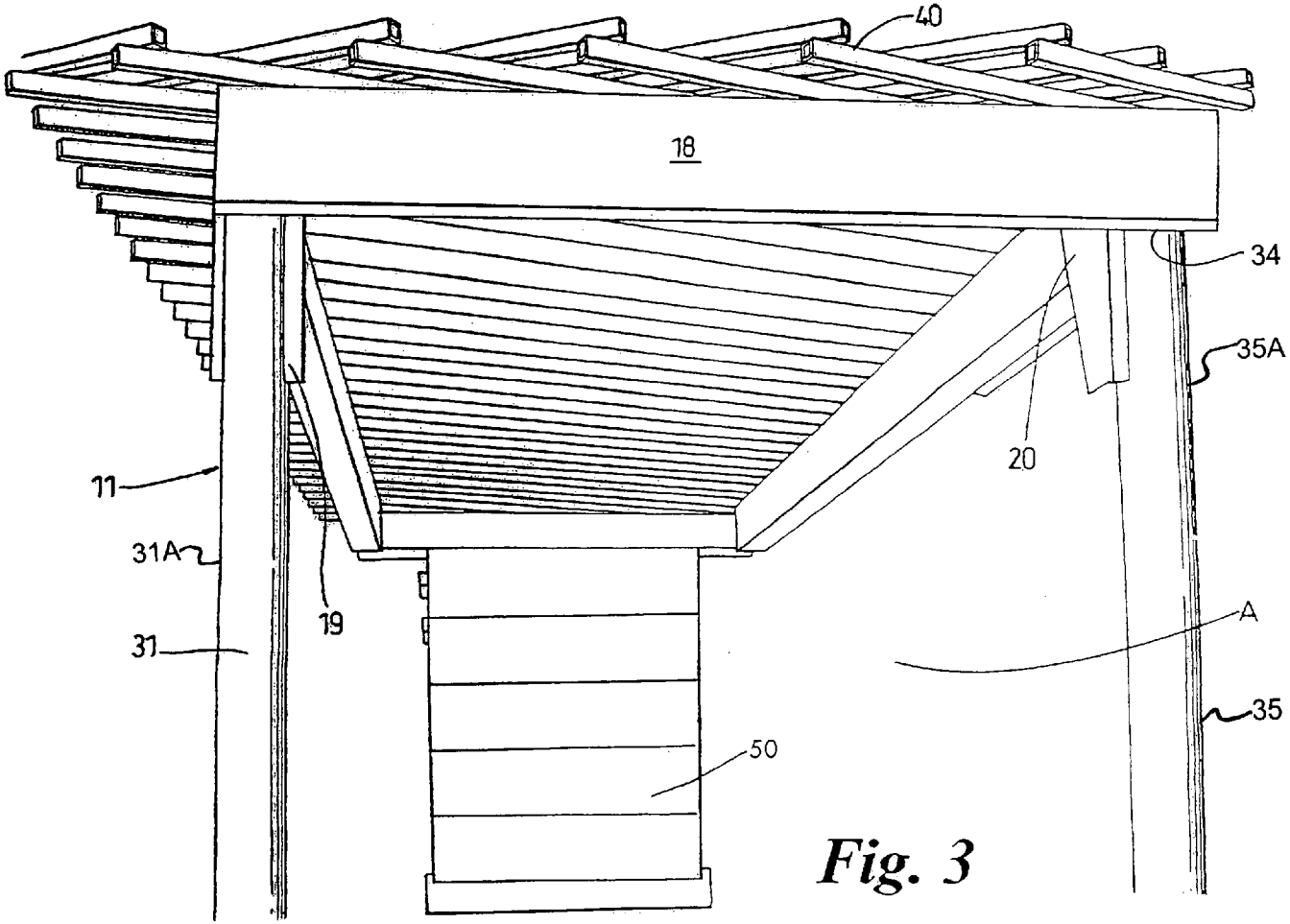
FIG. 3 is a pictorial end view of a mock up of significant parts of the unit of FIGS. 1 and 2 being used in combination with a movable platform.

In use the props 31,35 are extended as shown in FIG. 2 with the braces 32, 36 secured and the feet 31B, 35B are extended and clamped to ensure that the second base frame 18 is positioned in the opening 37 with the side arms 16, 17, 19, 20 are substantially horizontal. This configuration of the unit 11 while providing a secure structure does not intrude into the stair 50 and leaves a clear space A between the props (see FIG. 3) so that access is readily available to the foot of the stair 50 for individuals or equipment to pass between floors F1, F2.

INDUSTRIAL APPLICABILITY

The constructional or access unit 11 provides for a secure mounting to lie within opening. It is further provided with a closure member 40 in the form of a folding lattice (FIG. 3) of aluminium alloy which while being light is of substantial strength. A suitable closure member for this purpose is the safety unit the subject of our UK Application 2,339,824. This member 40 is readily slid into place to close, or out of position to give access to, opening 37. Being of openwork construction it is possible for somebody wishing to use the stair 50 (whether to ascend or descend) to view the region they wish to enter to establish whether or not it is safe to move the closure member 40. When in place the closure member 40 serves to prevent people or objects cannot inadvertently fall through opening 37.

Second base frame 18 lies within opening 37 and is supported there by telescopic props 31, 35. To ensure that the frame 18 is laterally supported when space 20 is otherwise clear of the frame 18 a pair of lateral props 41, 42 are provided which can be driven outwardly to seat against the side of the opening 37 and be locked their to limit lateral movement of frame 18 and so stabilise unit 11.

The invention claimed is:

1. An access unit for location in an opening in an upper floor, the access unit comprising:

a support frame having a generally 0-shaped configuration with an open central region, the support frame including U-shaped first and second members with an open end of each U-shaped member facing one another, each of the first and the second members comprises a base frame of fixed width defining one end of the open central region, and a pair of spaced apart side arms extending parallel to one another from opposite ends of the base frame; the pair of side arms of the first member being telescopically received within the pair of side arms of the second member to facilitate adjustment of a length of the open central region; and the open central region, defined by the base frame and the pair of spaced apart side arms of the first member and the base frame and the pair of spaced apart side arms of the second member, being completely unobstructed and open without anything being located between the base frames for the first and the second members so as to allow unhindered passage of a person through the open central region, and the telescopic adjustment of the pair of spaced apart side arms facilitates desired spacing of the base frame of the first member from the base frame of the second member over a range of distances; and each of the spaced apart side arms of the second member having a clamp for temporary securing of the side arms of the first member to the side arms of the second member at a pre-determined relationship and maintaining the desired spacing of the base frame of the first member from the base frame of the second member;

only the second member having a pair of spaced apart vertically adjustable props which are pivotably attached adjacent the base frame of the second member for supporting the second member at a desired level;

the first member having a flame arranged for overlying a support surface, at the first location, so that the flange at least partially overlaps a surface of the first location and solely vertically supports the first member at the first location; and the pair of spaced apart adjustable props of the second member facilitate positioning of the second member at substantially a same level as the first member, supported by the flange, so as to position the support frame of the access unit within a stairwell in a substantially horizontal orientation.

2. The access unit according to claim 1, wherein a length of each adjustable prop is variable to facilitate maintaining the access unit in one of a horizontal orientation and at a desired angle relative to horizontal.

3. The access unit according to claim 1, further comprising a removable platform member for covering the open central region, when the platform member is in a first working position, and preventing passage of one of the person and an article located above the support unit from inadvertently passing through the open central region; and the plafform member, when the plafform member is in a second position removed from the open central region, allowing unimpeded passage of at least one of the person and the article through the open central region.

4. The access unit according to claim 3, wherein the platform member is at least in part of open construction to enable viewing through the open central region when the platform member is in the first working position.

5. The access unit according to claim 3, wherein a length of each of the pair of spaced apart side arms of the first member is greater than a length the base frame of the first member.

6. The access unit according to claim 1, wherein a space between the base frame of the first member and the base frame of the second member is completely unobstructed, a space between the opposed legs of the first member is completely unobstructed, and a space between the opposed legs of the second member is completely unobstructed.

7. A constructional unit comprising:

a support frame which is O-shaped in plan bounding an open central region, the support frame including first and second members which are each U-shaped in plan, each of the first and the second members being in the form of a base frame of fixed width from which extend two side arms and an open end of each of the first and the second U-shaped members facing one another;

the first and the second members each having their side arms are telescopically engaged to define sides to the open central region of the O-shaped support frame;

the telescopic engagement providing for the spacing of the first base frame from the second base frame to be adjustable over a range of distances and for the temporary securing of the first member to the second member at a predetermined spacing;

the base frame of the first member being provided with means whereby the base frame is located at a first level at a first working location; the second member being adapted for location at a second working location off-set from the first working location, by means of at least one extensible leg, the, or each, extensible leg being pivotally attached at or near one end of the leg to the base frame of the second member or to a side arm thereof, the at least one extensible leg being pivotally attached only to the second member or the side arm thereof;

the opposite end to the one end of the, or each, extensible leg being adapted for location vertically below the first level; and the first member having a flange arranged for overlying a support surface, at the first location, so that the flange at least partially overlaps a surface of the first location and solely vertically supports the first member at the first location.

8. The constructional unit according to claim 7, wherein the, or each, extensible leg is provided with a strut with first and second ends, the first end of the strut being attachable to the extensible leg, the second end of the strut being attachable to the second member, the prop in use providing for a fixed angular alignment of the leg relative to the second member.

9. The constructional unit according to claim 7, wherein a platform member is provided to which, in a first working configuration, serves to cover the open central region of the support frame so as to prevent the inadvertent passage of an article or person through the open central region and a second working configuration wherein the platform member is withdrawn to allow access through the open central region.

10. The constructional unit according to claim 9, wherein the platform member is, at least in part, of openwork construction to enable a view to be obtained through the open central region, when the platform member is in the first working configuration.

11. A constructional unit (11) for preventing at least one of people and articles from passing through a passageway in a surface of an upper floor, the constructional unit (11) comprising:

a first support member (13) comprising two side arms (16, 17) and a base (15), each of the two side arms (16, 17) of the first support member (13) has an end that is coupled to a respective end of the base (15) of the first support member (13), such that the two side arms (16, 17) of the first support member (13) extend from the base (15) of the first support member (13) substantially parallel to each other and normal to the base (15) of the first support member (13), and such that the first support member (13) is substantially U-shaped;

a second support member (14) comprising two side arms (19, 20) and a base (18), each of the two side arms (19, 20) of the second support member (14) has an end that is coupled to a respective end of the base (18) of the second support member (14), such that the two side arms (19, 20) of the second support member (14) extend from the base (18) of the second support member (14) substantially parallel to each other and normal to the base (18) of the second support member (14), and such that the second support member (14) is substantially U-shaped;

ends of the two side arms (16, 17) of the first support member (13) that are remote from the base (15) of the first support member (13) are telescopically received by ends (19A, 20A) of the two side arms (19, 20) of the second support member (14) that are remote from the base (18) of the second support member (14);

two clamps (C1, C2) secure the two side arms (16, 17) of the first support member (13) to the two side arms (19, 20) of the second support member (14) such that the first support member (13) is adjustably secured to second support member (14), the first and the second support elements (13, 14) forming a substantially planar support frame having an open region (12) defined by the two side arms (16, 17; 19, 20) and the bases (15, 18) of the first and the second support elements (13, 14);

two props (31, 35) each having an end that is attached to a respective one of the two side arms (19, 20) of the second support member (14), the two props (31, 35) extending from the two side arms (19, 20) of the second support member (14), the two props (31, 35) being supported by a surface that is horizontally lower than the surface of the upper floor;

two braces (32, 36) each having one end coupled to a respective one of the two side arms (19, 20) of the second support member (14) and an opposite end coupled to a respective one of the two props (31, 35) to secure the two props (31, 35) with respect to the support frame;

the base (15) of the first support member (13) comprises a flange (15A) which extends from the base (15) of the first support member (13) in an opposite direction from the two side arms (16, 17) of the first support member (13), such that the flange (15A) contacts and overlays the surface of the upper floor along an edge of the passageway to support a first side of the support frame; and the two props (31, 35) are adjustable such that, when the first side of the support frame is supported by the flange (15A) on the surface of the upper floor along the edge of the passageway, the support frame is adjustable to be located within the passageway and substantially coplanar with the upper floor.

12. The constructional unit (11) according to claim 11, wherein the two props (31, 35) are pivotable with respect to the two side arms (19, 20) of the second support member (14) between a folded position, in which the two props (31, 35) lie adjacent the two side arms (19, 20) of the second support member (14), and an extended position, in which the two props (31, 35) extend substantially normal to the support frame.

13. The constructional unit (11) according to claim 12, wherein the ends of the two props (31, 35) are attached to the two side arms (19, 20) of the second support member (14) such that the two props (31, 35) only extend below the planar support frame.

14. The constructional unit (11) according to claim 11, wherein the ends of the two props (31, 35) are attached to the two side arms (19, 20) of the second support member (14) at a location along the two side arms (19, 20) of the second support member (14) that is spaced from the end of the two side arms (19, 20) of the second support member (14) coupled to the base (18) of the second support member (18).

15. The constructional unit (11) according to claim 11, wherein a platform (40) is supported by the support frame and is adjustable between a closed position, in which the platform (40) encloses the open region (12) of the support frame and the passageway in the surface of the upper floor, and a retracted position, in which the platform (40) is at least partially displaced from the open region (12) of the support frame and the passageway in the surface of the upper floor.

16. The constructional unit (11) according to claim 11, wherein only the two props (31, 35) and the flange (15A) support the support frame within the passageway in the surface of the upper floor.

17. The constructional unit (11) according to claim 11, wherein the first side of the support frame is supported only by the flange (15A).

* * * * *